United States Patent [19]

Joly

[11] Patent Number: 4,541,222

[45] Date of Patent: Sep. 17, 1985

[54] METHOD OF WRAPPING A SPOOL WITH METALLIC RIBBON

[75] Inventor: Arthur Joly, Auberchicourt, France

[73] Assignee: S.A. Joy & Cie, Auberchicourt, France

[21] Appl. No.: 474,267

[22] Filed: Mar. 11, 1983

[30] Foreign Application Priority Data

Mar. 11, 1982 [FR] France ..... 82 04648

[51] Int. Cl.[4] ..... B65B 13/02

[52] U.S. Cl. ..... 53/399; 206/398; 206/400; 53/409

[58] Field of Search ..... 53/397, 399, 409; 206/398, 400, 401; 220/72; 493/954, 112

[56] References Cited

U.S. PATENT DOCUMENTS

| | | | |
|---|---|---|---|
| 1,873,618 | 8/1932 | Miller | 206/400 |
| 1,913,477 | 6/1933 | Daubmeyer et al. . | |
| 1,981,140 | 11/1934 | Bureau et al. | 206/401 |
| 2,045,652 | 6/1936 | Hopkins | 206/398 |
| 2,134,128 | 10/1938 | Hopkins | 206/398 |
| 2,642,990 | 6/1953 | Schaefer et al. | 206/401 |
| 3,235,067 | 2/1966 | Hultgren | 206/400 |

FOREIGN PATENT DOCUMENTS

| | | |
|---|---|---|
| 2095890 | 2/1972 | France . |
| 2251481 | 6/1975 | France . |
| 2324140 | 4/1977 | France . |

*Primary Examiner*—John Sipos
*Assistant Examiner*—Donald R. Studebaker
*Attorney, Agent, or Firm*—Kerkam, Stowell, Kondracki & Clarke

[57] ABSTRACT

The invention relates to a method of wrapping a spool with metal ribbon, as well as to the spool and to the ribbon designed to carry out the method. The method is particularly characterized by the fact that, while the ribbon (12) is still being profiled only transversely, it is first kept tangent to the band (7) of flanges (4), then, as it is being deformed elastically, it is wound progressively and, as winding proceeds, the edges are fixed on said binding (7) of the flanges (4) by applying stresses on the median portion in such a way as to cause it to bulge outwardly.

4 Claims, 2 Drawing Figures

METHOD OF WRAPPING A SPOOL WITH METALLIC RIBBON

BACKGROUND OF THE INVENTION

1. Field of the Invention

The invention relates to a method of wrapping a spool with metallic ribbon, as well as to the spool and to the ribbon designed to carry out said method, and to the spool so wrapped.

2. Description of the Prior Art

To store and handle wires, cables, and sheets, these products are normally packed on spools, usually referred to as "reels", composed of a hub and two flanges. Such spools are provided with a wrapping or cover to protect them against blows and attack by foreign substances.

In previously known structures, this wrapping or cover consisted of a number of crosspieces of wood disposed parallel to the axis of the spool, with the ends of the pieces resting on the two flanges of the spool and being nailed on the periphery thereof. However, protection of the wound spools in this manner was time-consuming and costly.

To facilitate the installation of these crosspieces, these crosspieces may be preassembled to form a curtain which then need only be unwound and wrapped around the spool, with the two ends thereof being connected together by applying a tension between them to ensure that the wrapping is held fast. (French Pat. No. 2,095,890).

These crosspieces, generally referred to as "staves" by analogy with the longitudinal pieces of wood forming the body of barrels, which rest on the periphery of the flanges of the spool have the drawback of increasing very considerably the space taken up by the spools which, needless to say, increases the cost of transport and storage. In addition to this considerable increase in the space taken up by the spools, these crosspieces have also proven to be fragile to impacts.

To obtain a more resistant wrapping, it is also well known (U.S. Pat. No. 1,913,477) to substitute for the crosspieces of wood, crosspieces of metal or protecting plates that have previously been flanged so that thereafter they can assume without stress the shape of the periphery of the flanges on which they will be fixed.

The crosspieces distributed on the periphery of the spools, be they of wood or of metal, include gaps between them that enable foreign substances to gain access to the product packed on the spool. Further, these crosspieces from flat surfaces on the periphery of the spool that interfere with the rolling of the spools on the ground. Further, when handling of these spools, engagement of the lift straps under the spool is difficult because, at least in the case of the crosspieces of wood, the spool rests on the ground along an entire generating line.

To overcome some of the drawbacks resulting from the use of wood staves or metal protecting plates, it is common practice (French Pat. No. 2,324,140) to wrap the product packed on the spool with a ribbon whose width is slightly less than the distance between the flanges. Such a ribbon no longer rests on the periphery of the flanges, but rather on the wound product itself, that is to say, usually after the interposition of blocks of plastic foam.

If the ribbon does not increase the space taken up by the spools, the ribbon does not interfere with the winding operation and enables the lift straps to pass. However, unlike the staves of wood which assures the clamping of the flanges together, the ribbon no longer strengthens the spools. Moreover, despite the plastic-foam blocks that may be interposed, impacts on the ribbon are quickly transmitted to the product.

The major drawbacks, however, remain in the necessity either of splitting the ribbon in order to adapt it to the actual width of each spool, whose factory tolerances are rather substantial, or making the ribbon considerably less wide than the average distance between the flanges in order to allow for factory tolerances. In such arrangements the product may be undesirably uncovered near the flanges.

Where the thickness of the ribbon does not excessively increase the diametrical space occupied by the spools, it is well known (French Pat. No. 2,251,481) to use a ribbon with a width greater than the distance measured between the external surfaces of the flanges in order to obtain a better covering over of the product, so that, in the manner of staves, the edges of this ribbon rest on the periphery of the flanges of the spool while its median portion is situated in the same plane as said edges and surrounds the product. For its immobilization in axial translation, the surplus marginal strips of the ribbon are then simply bent down against the edge of the external surfaces of the flanges.

To prevent them from producing stresses in the median portion of the ribbon and to facilitate the bending-down operation prior to said operation, the marginal strips are subjected to an undulation process.

If the ribbon does not increase materially the space taken up by the spool, since it is fixed simply by bending down the marginal strips, it is nevertheless insufficiently anchored to strengthen the spool. Also, for that matter, it fails to prevent the marginal strips from slipping in the event of an impact on its median portion, so that the slightest deformation places said marginal strips in a position which causes them to disengage.

In addition, as in the case of staves of wood or metal protection plates, the spool rests on the ground along an entire generating line so that, in order to lift it, the straps cannot simply be slipped under the spool. To free a passage for the straps and especially to achieve a relative strengthening of the spool, it is also well known (U.S. Pat. No. 2,642,990) to provide the periphery of the spool with a ribbon that has previously and permanently be profiled not only transversely so that, with respect to its median portion which extends to the vicinity of the internal surfaces of the flanges, its edges are raised in order to create grooves that cover the periphery of said flanges, but also longitudinally in accordance with the curves of the flanges so as to avoid any stress in the ribbon during and after its installation. Short of providing thick and, hence, heavy and costly, ribbons, the ribbon of a spool wrapped according to this method still tolerates the slightest shock caused by the deformations of its median portion.

It is also common practice (U.S. Pat. No. 2,642,990) to flange transverse ribs in this ribbon not only to guarantee its longitudinal profiling without stresses, but especially to strengthen it transversely. Unfortunately, however, this also increases the cost price and interferes with the passage of the lift straps.

SUMMARY OF THE INVENTION

The subject invention relates to a method of wrapping a spool with a relatively thin metal ribbon that results in a wrapping which, without either increasing the space taken up by the spool or interfering with the passage of the first straps, is very resistant and is firmly anchored on the spool, which is even strengthened by it.

Therefore, the object of the invention is to provide a method of wrapping a spool with metal ribbon which is profiled transversely such that its edges are placed in a plane which is both parallel to the plane of its median portion and juts out on the external surface of said median portion of the profiled ribbon. This method is especially characterized by the fact that, while the ribbon is still being profiled only transversely it is first held tangent to the hoops or bands of the flanges by applying stresses on the median portion in such a way as to cause it to bulge outwardly.

Another object of the invention is to provide the spool and the ribbon designed especially to carry out the aforementioned inventive method, as well as the spool so wrapped.

BRIEF DESCRIPTION OF THE DRAWINGS

The invention will be better understood with the aid of the ensuing description given by way of non-limitative example, reference being had to the accompanying drawing in which in.

DESCRIPTION OF THE PREFERRED EMBODIMENTS

Figure 1:
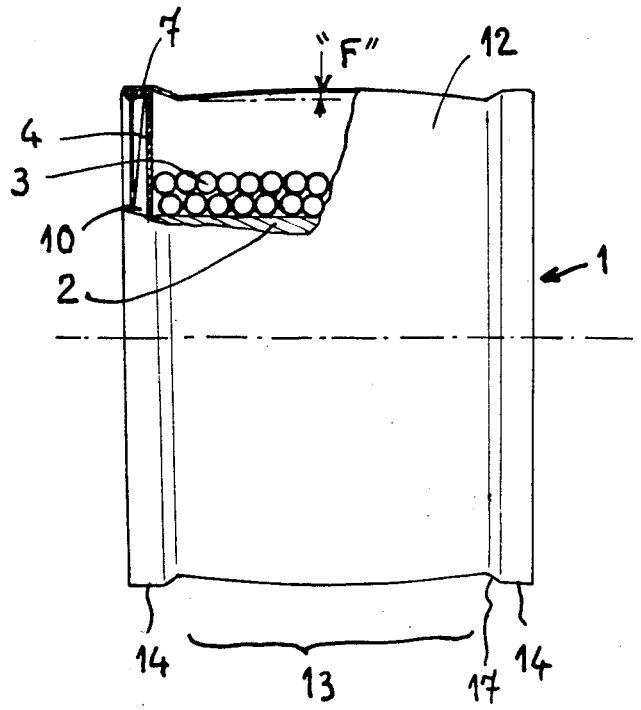
FIG. 1 is a fragmentary side elevational view of a spool provided with the wrapping according to the invention, one part of which is removed to show an axial cross-sectional view of the interior.

Now, referring to the drawing, it can be seen that the spool 1 comprises a hub 2 on which the product 3, such as cable, is wound. The hub 2 is mounted between two flanges 4 having a generally circular shape, each constituted by a metal sheet 5 having folds or wrinkles 6 that form radial stiffening ribs. Resting on the ribs 6, each flange is provided on its periphery with a hoop or band 7 which facilitates the winding of the spool on the ground.

The flanges have substantially flat internal surfaces and are provided with ribs 6 with a width which, following the example of the stresses to which they are exposed, decreases in a direction away from the center of the spool, so that the surface generated by the rotation of the top 9 is substantially conical.

Figure 2:
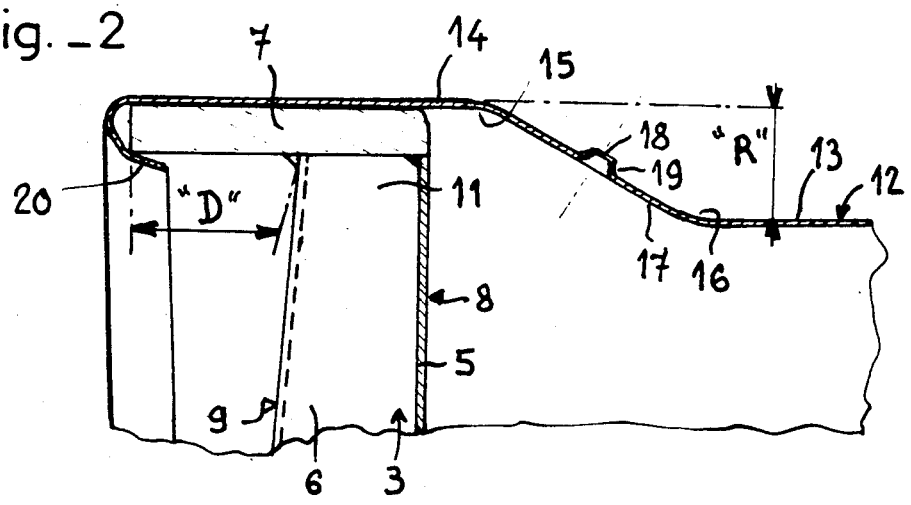
FIG. 2 is a detail on a larger scale illustrating the linkage between the ribbon and one of its flanges.

According to one feature of the invention, in order to carry out the method of wrapping the spool, the spool is constructed with band 7 in the form of a cylindrical skirt disposed outwardly of the surface generated by the rotation of the top 9 of the ribs by a distance "D" shown in FIG. 2 which, in order not to modify the space taken up by the spool, is at the most equal to the difference in width of the ribs between the foot portion 10 situated near the center of the spool and the head portion 11 located under the band 7.

For its wrapping, spool 1 is loaded with the product 3, and is provided with one or more lengths of the ribbon 12 made, for example, from galvanized or electrozincked steel or from aluminum or stainless steel, say, 1 mm thick.

This ribbon has a median portion 13 which, extending to the vicinity of the internal surfaces of the flanges, surrounds the product, while its marginal strips 14 rest on the band 7 of said flanges 4.

Prior to winding around the flanges of the spool, the ribbon 12 is profiled in such a way that its marginal strips 14 are placed in a plane which is parallel to the plane of its median portion 13. The said marginal strips 14 jut out on the external surface of band 7 and are connected to said median portion of the profiled ribbon by sides inclined with respect to both the median portion 13 and marginal strips 14.

This ribbon is thus shaped only transversely and, therefore, is still rectilinear in the longitudinal direction. It is first held tangent to the band 7 of the flanges 4. Then, by deforming it elastically, it is gradually wound by fixing its marginal strips 14 around the bands 7 as winding proceeds.

Because of the difference in diameter of ribbon 12 and strips 14, shown best by "R" in FIG. 2, the median portion 13 tends to wind around a cylinder with a smaller diameter than that on which said marginal strips 14 are wound. Thus, for the same angle in the center, these cylinders have arcs of different lengths.

However, since the material strips and the median portion 13 of the ribbon 12 have the same developed length, it follows that during winding the marginal strips 14 of the ribbon 12 are subjected to stresses of extension in the longitudinal direction and, in particular, compressive stresses in its median portion 13, which then tends to bulge outwardly in order to reach the cylinder comprising the neutral fiber of the profiled ribbon.

This compressive stress and the arrow "F" resulting therefrom in the median portion 13 (FIG. 1) have the considerable advantage of increasing substantially, with equal thickness, the necessary force for forcing up said median portion 13 which, therefore, will not rest on the product.

Preferably, the distance "R" will range between 15 and 25 mm, e.g., 20 mm. It will be possible to separate the median portion 13 from each edge 14 by a double reversed fold 15, 16 which delimits an inclined side 17 therebetween. The inclined sides 17 of the ribbon may have holes 18 which enable the product 3 to be ventilated. To prevent water, which can run down on the wrapping, from entering beneath the wrapping, the holes 18 will preferably be surrounded by an outwardly turned collar 19.

According to another feature of the invention, a ribbon with adequate width is provided to enable its marginal strips 14 to extend beyond the external edge of the bands in the form of a marginal strip 20 and, as the winding of the ribbon proceeds, strip 20 is bent down not only against the edge of the band, but also under the edge thereof in the form of a hook, as shown in FIG. 2. Thereby, the edge is firmly anchored. This guarantees that the winding of the profiled ribbon will be effected around the external plane of the band 7 and will produce the desired stress in the median portion. Moreover, this will enable a stress and a transverse extension to be conferred upon the median portion to strengthen the spool.

Indeed, thanks to this stress, the ribbon energetically resists moving apart of the flanges when, for example, during transport the product the flanges tend to move on the hub. To strengthen the edges and marginal strips 14, they can of course be doubled.

Because of the difference in diameters as shown by "R" in FIG. 2, the ribbon acquires a certain transverse elasticity which enables correction of the differences in width on the order of approximately one cm that may exist between the spools because of their factory tolerances.

In the event of an impact on the median portion 13, as a result of the distances shown by "R" its deformation can only cause the double wrinkles 15, 16 to open without directly affecting the anchorage and tends to reclose the hook 20 forming the anchorage.

I claim:

1. A method of wrapping a spool (1) having a hub (2) on which a product, such as cable, is wound, and having two radially outwardly projecting flanges (4) having a generally circular shape and provided on their periphery with a cylindrical band (7), a metal preformed ribbon (12) having marginal portions (14) and a median portion (13), said ribbon being profiled transversely such that its marginal portions (14) are disposed in a plane which is parallel to the plane of the median portion (13) and juts out from the median portion (13) of the ribbon (12), said method comprising holding said ribbon marginal portions tangent to the band (7) of the flanges (4) while the ribbon is being profiled only transversely, and winding the ribbon around the spool with the marginal portions (14) on the band (7) of the flanges (4) while deforming the ribbon elastically to apply stresses on the median portion (13) of the ribbon in such a way as to cause the median portion to bulge outwardly.

2. The method as defined in claim 1, wherein, as the ribbon winding proceeds, further including bending an edge of each marginal portion of the ribbon against an edge of said band, and also under the band edge to hook the ribbon to the band.

3. A method as defined in claim 1, wherein prior to being wound on the spool the ribbon is oriented rectilinear in the longitudinal direction.

4. The method as defined in claim 2, further including providing between the median portion and each of the marginal portions a double reversed fold (15, 16) which delimits an inclined side therebetween.

* * * * *